US009650849B2

(12) United States Patent
Jelgert et al.

(10) Patent No.: US 9,650,849 B2
(45) Date of Patent: May 16, 2017

(54) DRILLING RIG ROD HANDLING APPARATUS

(71) Applicant: SANDVIK INTELLECTUAL PROPERTY AB, Sandviken (SE)

(72) Inventors: Johan Jelgert, Lindesberg (SE); Lars-Erik Larsson, Nora (SE); Per Vilen, Nora (SE); Kent Evermark, Karlstad (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/891,532

(22) PCT Filed: Apr. 9, 2014

(86) PCT No.: PCT/EP2014/057155

§ 371 (c)(1),
(2) Date: Nov. 16, 2015

(87) PCT Pub. No.: WO2014/183929

PCT Pub. Date: Nov. 20, 2014

(65) Prior Publication Data

US 2016/0115751 A1 Apr. 28, 2016

(30) Foreign Application Priority Data

May 17, 2013 (EP) ..... 13168187

(51) Int. Cl.

| | |
|---|---|
| ***E21B 19/20*** | (2006.01) |
| ***E21B 19/16*** | (2006.01) |
| ***E21B 7/02*** | (2006.01) |
| ***E21B 19/15*** | (2006.01) |
| ***E21B 19/24*** | (2006.01) |

(52) U.S. Cl.

CPC ..... *E21B 19/161* (2013.01); *E21B 7/02* (2013.01); *E21B 19/15* (2013.01); *E21B 19/165* (2013.01); *E21B 19/20* (2013.01); *E21B 19/24* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,043,619 A | | 7/1962 | George et al. | |
| 3,424,257 A | * | 1/1969 | Kotlyarov | E21B 19/20 175/85 |
| 4,531,875 A | * | 7/1985 | Krueger | E21B 19/20 211/70.4 |
| 6,220,807 B1 | | 4/2001 | Sorokan | |

(Continued)

FOREIGN PATENT DOCUMENTS

| | | | | |
|---|---|---|---|---|
| EP | 0171368 A1 | | 2/1986 | |
| GB | 2334270 A | * | 8/1999 | E21B 19/155 |

(Continued)

*Primary Examiner* — David Andrews
*Assistant Examiner* — Ronald Runyan
(74) *Attorney, Agent, or Firm* — Corinne R. Gorski

(57) ABSTRACT

A drill rod handling apparatus is configured to feed rods to and from a drill string created by a drill rig. The apparatus includes a gripper unit configured to contact and hold a rod to be transported to the drill rig and an alignment tool mounted at the gripper unit to provide correct mating of the rod ends during coupling.

15 Claims, 10 Drawing Sheets

(56) References Cited

U.S. PATENT DOCUMENTS

| | | | | |
|---|---|---|---|---|
| 6,550,128 | B1 | 4/2003 | Lorenz | |
| 7,036,202 | B2 * | 5/2006 | Lorenz | E21B 19/155 166/77.51 |
| 8,235,104 | B1 | 8/2012 | Sigmar et al. | |
| 8,955,620 | B2 * | 2/2015 | Littlely | E21B 19/10 175/220 |
| 2004/0049905 | A1 | 3/2004 | Jansch et al. | |
| 2005/0269072 | A1 * | 12/2005 | Folk | E21B 19/08 166/90.1 |
| 2006/0096783 | A1 | 5/2006 | Landry | |
| 2011/0200412 | A1 | 8/2011 | Orgeron | |
| 2011/0247880 | A1 | 10/2011 | Wrede et al. | |
| 2012/0168227 | A1 | 7/2012 | Littlely et al. | |

FOREIGN PATENT DOCUMENTS

| | | | |
|---|---|---|---|
| WO | 00/65193 | A1 | 11/2000 |
| WO | 02/079603 | A1 | 10/2002 |
| WO | 03/031766 | A1 | 4/2003 |
| WO | 2011/129760 | A1 | 10/2011 |

* cited by examiner

DRILLING RIG ROD HANDLING APPARATUS

RELATED APPLICATION DATA

This application is a §371 National Stage Application of PCT International Application No. PCT/EP2014/057155 filed Apr. 9, 2014 claiming priority of EP Application No. 13168187.6, filed May 17, 2013.

FIELD OF INVENTION

The present invention relates to drill rod handling apparatus to feed rods to and from a drill string created by a drill rig.

BACKGROUND ART

Exploration drilling typically involves drilling to subterranean depths of thousands of meters. Accordingly, it is necessary to join and install successive sections of pipe or rod as the drill string is advanced into the well.

Drill rod, depending on their specific configuration, may weigh between ten to twenty kilograms each and measure approximately two to three meters in length. Conventionally, the drill rods are interconnected by male and female threaded connections provided at the respective rod ends. Additionally, it is typically unavoidable to have to exchange the drill bit or other tools at the lowermost end of the drill string at regular intervals during drilling. This exchange process involves retrieving the entire drill string from the borehole, exchanging the lowermost portion and then reinstalling the entire drill string after which drilling may continue. In practice, and depending upon rock conditions, it is not uncommon for ten to twenty retrieval operations to be undertaken per drill hole. Accordingly, a very large number of drill rods are required to be handled and in particular taken from a transport or carriage carrier to the drilling rig where they are ready for axial alignment and coupling to the drill string. Of course, the reverse operation is also required during string retrieval. Example rod handling systems are disclosed in U.S. Pat. No. 3,043,619; GB 2334270; WO 00/65193; and WO 2011/129760.

A rod handling system may typically comprise a robot arm having a dedicated gripper for gripping the drill rods. During a forward drilling operation, the robotic arm is arranged to pick up drill rods at a transport or intermediate carrier and to place the drill rod in the drill rig, whereupon the drill rod is connected to an already installed drill rod to extend the drill string. During a drill string retrieval operation, the robotic arm is arranged to pick up disconnected rods from the drill rig and to replace them onto the transport or intermediate carrier.

In order to provide a fully automatic system, that eliminates the need for regular manual intervention, it is desirable for the rod handling system to be able to connect and disconnect the drill rod to/from the installed drill rods. However, the threads used in many drilling applications, including wire-line and core drilling, typically have a very low thread height, and are slightly conical. If a pair of such threads is brought together axially at random, experience shows that there is about 60% chance of the threads not engaging each other, or engaging each other incorrectly. In either case, the threads may become damaged, resulting in additional cost and work.

WO 02/079603A1 discloses a system for automatically connecting drill rods to and form a drill string. In this system, marks are provided around the perimeter of the rods, such that their rotational positions can be determined, thus allowing the rods to be rotationally aligned for optimal thread entry. However, existing systems of this type cannot guarantee alignment and there remains a risk of the rods and their threads being damaged by misalignment. Accordingly, there is a need for a rod handling system for interconnecting drill rods that addresses the above problems.

SUMMARY OF THE INVENTION

It is an objective of the present invention to provide a rod handling apparatus and in particular an automated assembly configured to reliably and quickly transport rods to the drill string and to ensure correct axial alignment when coupling the rods to both avoid damage to the threaded connections of the rods and rod misalignment which would otherwise prevent or delay the drilling operation.

The objections are achieved by providing a rod handling apparatus having an alignment tool configured specifically to mechanically guide the coupling operation as one rod is added to the rear end of the drill string at the drill rig. Advantageously, the present alignment tool is mounted at a rod gripper unit via an elongate beam that is specifically configured to undergo relatively small to modest lateral deflections from the longitudinal axis of the drill string and/or rod that is being connected. The present alignment tool is therefore configured to be self-guiding as the transported rod is brought into touching contact with the drill string to correctly align the threaded connections. The alignment tool is also provided with a coupling region or sleeve having an internal diameter corresponding closely to the external diameter of the rods to provide a guide conduit to force correct axial alignment.

Via suitable control means conventional to the art, the present rod handling apparatus provides an automated handling system to reliably couple rods of the drill string with little or no manual intervention required.

According to a first aspect of the present invention there is provided drill rod handling apparatus to feed rods to and from a drill string created by a drill rig, the apparatus comprising: a gripper unit comprising: rod engagers for contacting and holding a first rod to be transported to the drill rig; a transporter to transport the gripper unit from a rod collection position to a rod coupling position at the drill rig such that the first rod is aligned axially with the drill string at the rod coupling position; characterised by: an alignment tool mounted at the gripper unit via an elongate connector, the alignment tool having a pair of alignment jaws, at least one of the jaws being moveable to allow the jaws to open and close around the first rod; wherein a part of the jaws in a closed state define a coupling region and a guide mouth projecting radially outward from one end of a part of the coupling region to guide axial alignment of the coupling region over a second rod forming an end of the drill string to provide aligned coupling of the first and second rods within the coupling region.

Reference within the specification to an 'elongate connector' encompass means to mechanically attach the alignment tool to the gripper unit such that the alignment tool is held substantially rigidly at the gripper unit so as to be supported by the gripper unit whilst being capable of lateral deflections radially outward from the longitudinal axis of the drill string. The elongate connector may comprise a beam or a plurality of connection elements that extend axially from the gripper unit.

Preferably, each jaw if pivotally mounted at a support frame and capable of pivoting to move radially to and from a longitudinal axis extending through the coupling region.

Optionally, the coupling region comprises a sleeve having a radially inward facing surface with a substantially cylindrical shaped profile. Optionally, the coupling regions may comprise a plurality of elements arranged around the longitudinal axis so as to provide a contained coupling zone into which the ends of the first and second rods may be positioned and held during coupling. Preferably, the coupling region comprises an internal cavity region having a width or diameter being slightly greater than an external diameter of the rods.

Preferably, the guide mouth comprises a radially inward facing surface having a substantially conical shaped profile. According to a further aspect, the guide mouth may comprise any projection or extension from the coupling region that is inclined or tapered radially outward from the coupling region inner surface so as to provide an angled surface for contact of the end rod of the drill string. Accordingly, the alignment tool is configured to self-align to the longitudinal axis of the drill string by virtue of a bending or flexing of the elongate connector. Accordingly, an axial length of the mouth section and an angle of orientation of the inward sloping surface may be selected to ensure the alignment tool will always 'catch' onto the end rod of the drill string and be guided by it to achieve correct alignment.

Preferably, the apparatus further comprises a drive actuator mounted at the support frame and coupled to at least one of the jaws to drive movement of the at least one jaw to open and close around the first rod.

Preferably, a first end of the elongate connector is mounted at the gripper unit and a second end of the elongate connector is mounted at the alignment tool, the connector configured to flex in a plane laterally (transverse/perpendicular) of its longitudinal axis such that the alignment tool is capable of lateral sideways deflections relative to the gripper unit.

Preferably, the rod engagers comprise: a pair of rod engaging jaws moveable to open and close about the first rod; and engaging rollers mounted at the jaws for contacting and holding the first rod in a clamped position at the gripper unit.

Preferably, the apparatus further comprises at least one sensor mounted at the gripper unit to detect an axial movement change between the gripper unit and the first rod. Optionally, the sensor may comprise a sensor configured to monitor the axial position of the sled relative to the frame. Optionally, the sensor is mounted at a sled or frame part of the gripper unit and is configured to monitor movement of a region of the alternate frame or sled. Optionally, the sensor may comprise any one or a combination of the following set of: an optical sensor; a laser; a camera; a pressure sensor configured to identify changes in hydraulic or pneumatic pressures associated with hydraulic or pneumatic means associated with the frame and/or sled; an accelerometer; a sound sensor; an electronic based sensor; an electric based sensor; a magnetic based sensor. Optionally, the sensor may comprise means to monitor a hydraulic or pneumatic pressure of an actuator that is associated with maintaining or adjusting the axial lengthwise movement of a sled or frame of the gripper unit.

Preferably, the coupling region is positioned substantially coaxially with the rod engaging jaws so that a first region of the first rod may be gripped by the rod engaging jaws and a second region of the first rod may be surrounded by the alignment jaws. Optionally, the guide mouth projects radially outward from an inward facing surface the coupling region at an angle in the range 5 to 20°. Preferably, the guide mouth projects radially at an angle of 5 to 15°; 6 to 14°; or 8 to 12°.

According to a second aspect of the present invention there is provided an automated drill rod handling assembly comprising the apparatus as claimed herein having means to control movement of the gripper unit and the alignment tool relative to the drill string according to an automated sequence.

According to a third aspect of the present invention there is provided a drill rig to feed rods to and from a drill string comprising: a feed frame; a rotation unit mounted at the feed frame to provide rotational drive to the drill string; a rod holder mounted at the feed frame to mount an end region of the drill string, the rotation unit being axially slidable to and from the rod holder; and rod handling apparatus as claimed herein configured to transport rods between the rod collection and rod coupling positions to axially align the first rod with an end rod of the drill string held by the rod holder and/or the rotation unit.

According to a fourth aspect of the present invention there is provided a method of feeding rods to a drill string created by a drill rig, the method comprising: contacting and holding a first region of first rod at a rod collection position via rod engagers positioned at a gripper unit; moving the gripper unit from the rod collection position to a rod coupling position where the first rod is aligned substantially axially with a second rod forming an end part of the drill string; characterised by: engaging a second region of a first rod axially separated from the first region by an alignment tool having a pair of alignment jaws that close around the second region and support the first rod via a coupling region defined by the jaws during the step of contacting the first region of the rod with the rod engagers; axially advancing the first rod towards the second rod; and guiding engagement of the second rod within the coupling region via a guide mouth flared radially outward from a part of the coupling region to position the first and second rods at least partially within the coupling region in axial alignment to be coupled.

Optionally, the step of contacting and holding the first region of the first rod comprises engaging the first region by a pair of engaging jaws that close around the first rod. Preferably, the method further comprises synchronising the closing of the engaging jaws and alignment jaws around the rod.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

The present apparatus is configured specifically to provide automated feeding of drill rods to a drill string at a drill rig. The present apparatus is intended to compensate for rather rough tolerances when aligning and adding rods to the drill string in which a robotic arm of rod handling apparatus is moveable to collect a rod from a storage position and to move the rod to a coupling position. In particular, when drilling, a rod gripped by a rotation unit at the rig undergoes slight oscillating movement due to the environmental conditions during drilling and somewhat limited gripping precision of the rotation unit. Accordingly, the exact position of the end rod of the drill string becomes misaligned from a 'true' axial centre. Additionally, a tolerance is also created by the robotic arm and handling system when moving a rod from the storage to the coupling position. The present rod handling apparatus provides a mechanical assembly that greatly facilitates alignment when coupling rods of the drill string given the tolerances in the mechanical components and the environment in which the drill rig is used.

Figure 1:
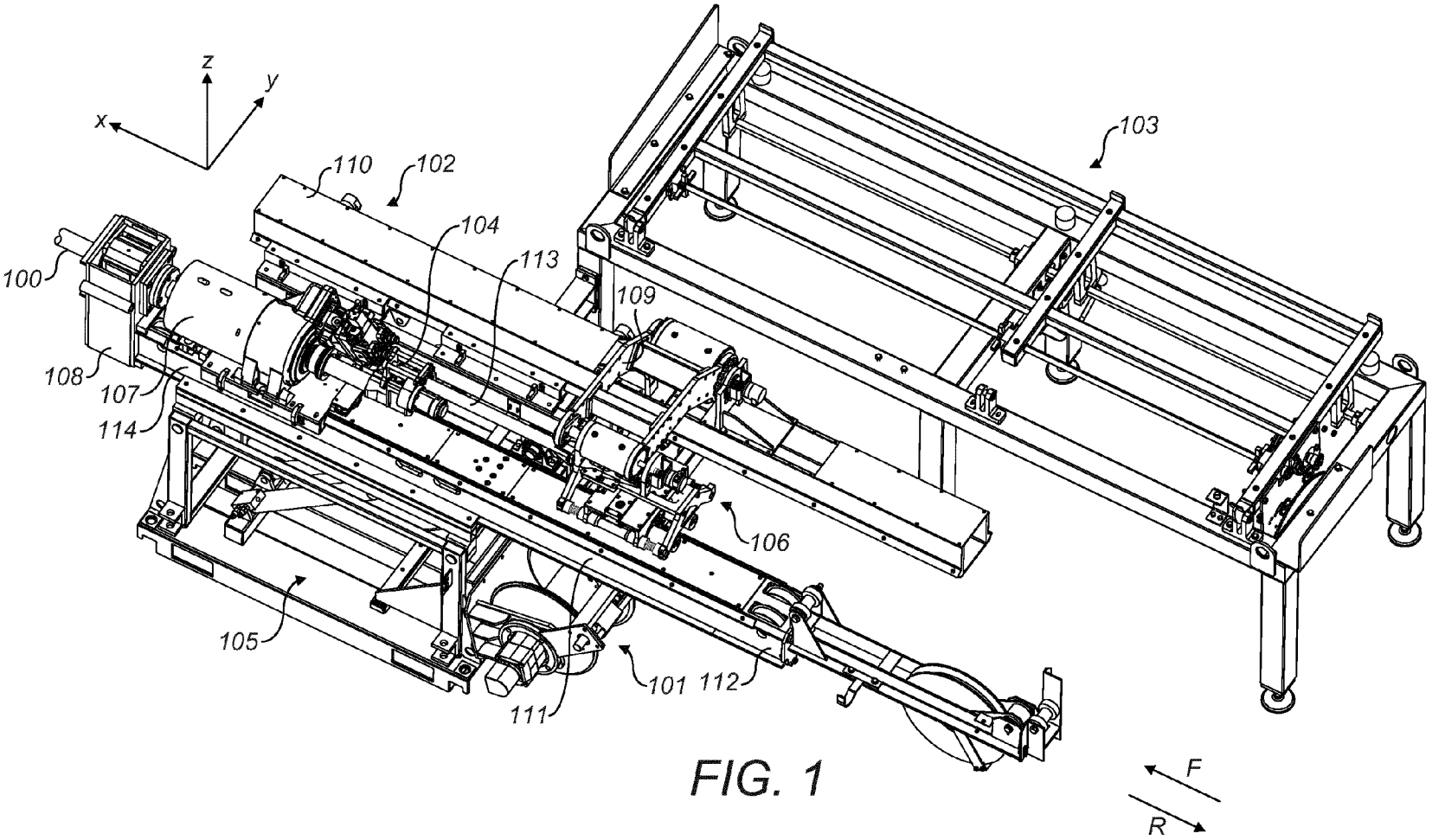
FIG. 1 is a first side perspective view of drill rig, a rod storage rack and rod handling apparatus positioned intermediate the drill rig and rack according to a specific implementation of the present invention.

Referring to FIG. 1, a drill rig 101 comprises a feed frame 111 having a first forward end 114 and a second rearward end 112 relative to a drill string. A rod holder 108 is mounted at first end 114 and is configured to hold an end rod 100 of the drill string that typically extends in a downward direction within a deep borehole. A rotation unit 107 is mounted behind holder 108 at frame 111 and comprises conventional components configured to rotate the drill string rods 100 during a drilling procedure. Feed frame 111 is mounted upon a ramp assembly 105 configured to adjust the drilling angle of rig 101. As illustrated, the drill string 100 extends in the x axis in which a rod drilling operation involves rotational advancement of the drill rods 100 in direction F whilst retraction of the rods from the borehole is undertaken in the opposite direction R both in the x axis.

Figure 2:
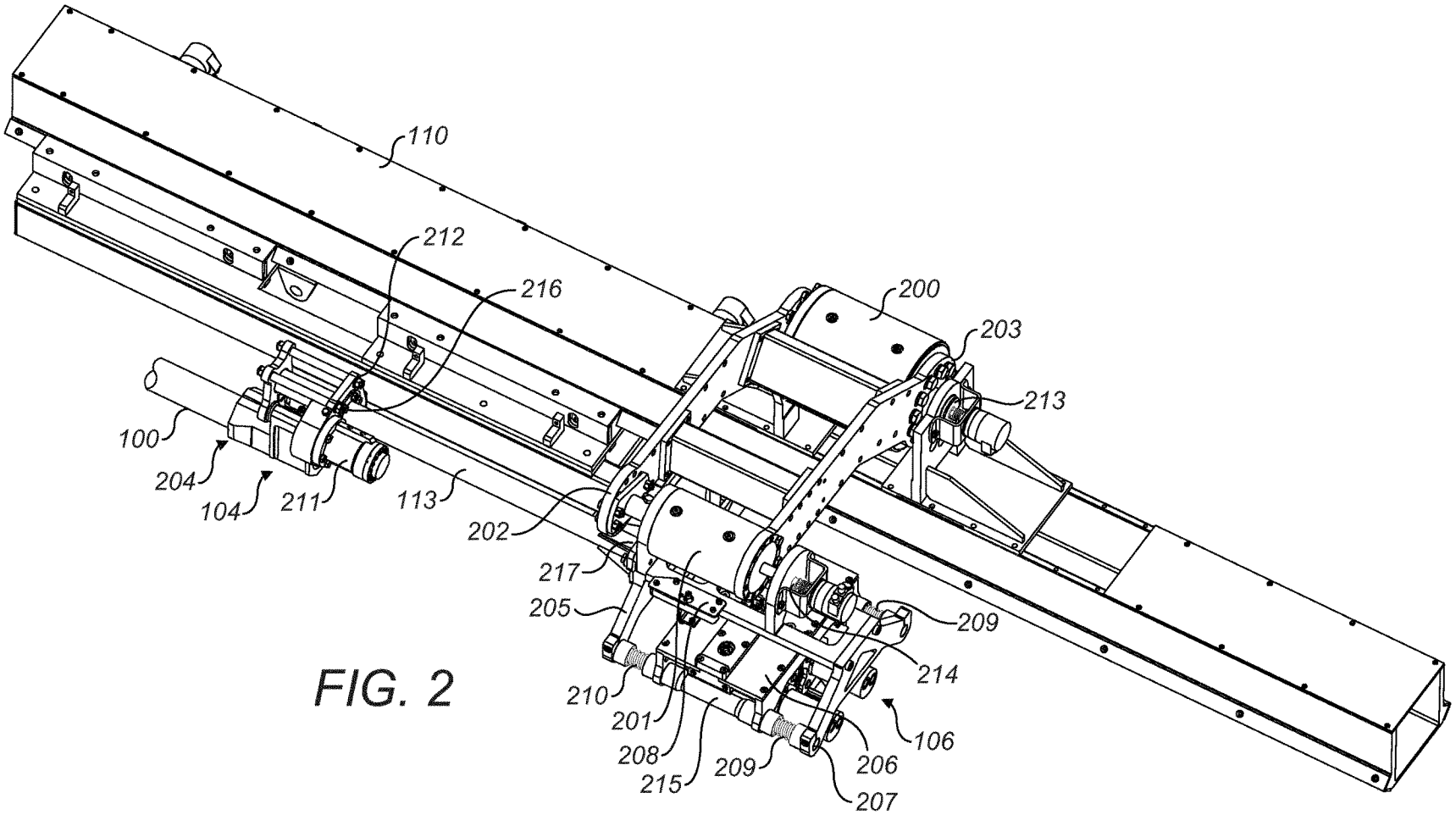
FIG. 2 is a second side perspective view of the rod handling apparatus of FIG. 1.

Rods to be supplied to drill rig 101 are transported and stored temporarily on a rod storage rack 103 positioned adjacent rig 101. Rod handling apparatus indicated generally by reference 102 is positioned intermediate rack 103 and rig 101 and is configured to transport rods between rack 103 and rig 101 during any drilling and retraction procedure. Referring to FIGS. 1 and 2, rod handling apparatus 102 comprises a guide frame 110 that mounts a transport unit in the form of a robotic arm 109 pivotally mounted at both its ends. A gripper unit 106 is mounted at one end of arm 109 and is configured to engage and hold rods to be transported between rack 103 and rig 101. To ensure rods are coupled efficiently and to avoid misalignment and damage during coupling, rod handling apparatus 102 further comprises an alignment tool 104 intended to engage an end rod of the drill string 100 and to mate the drill string with a 'transported' rod taken from rack 103.

Figure 3:
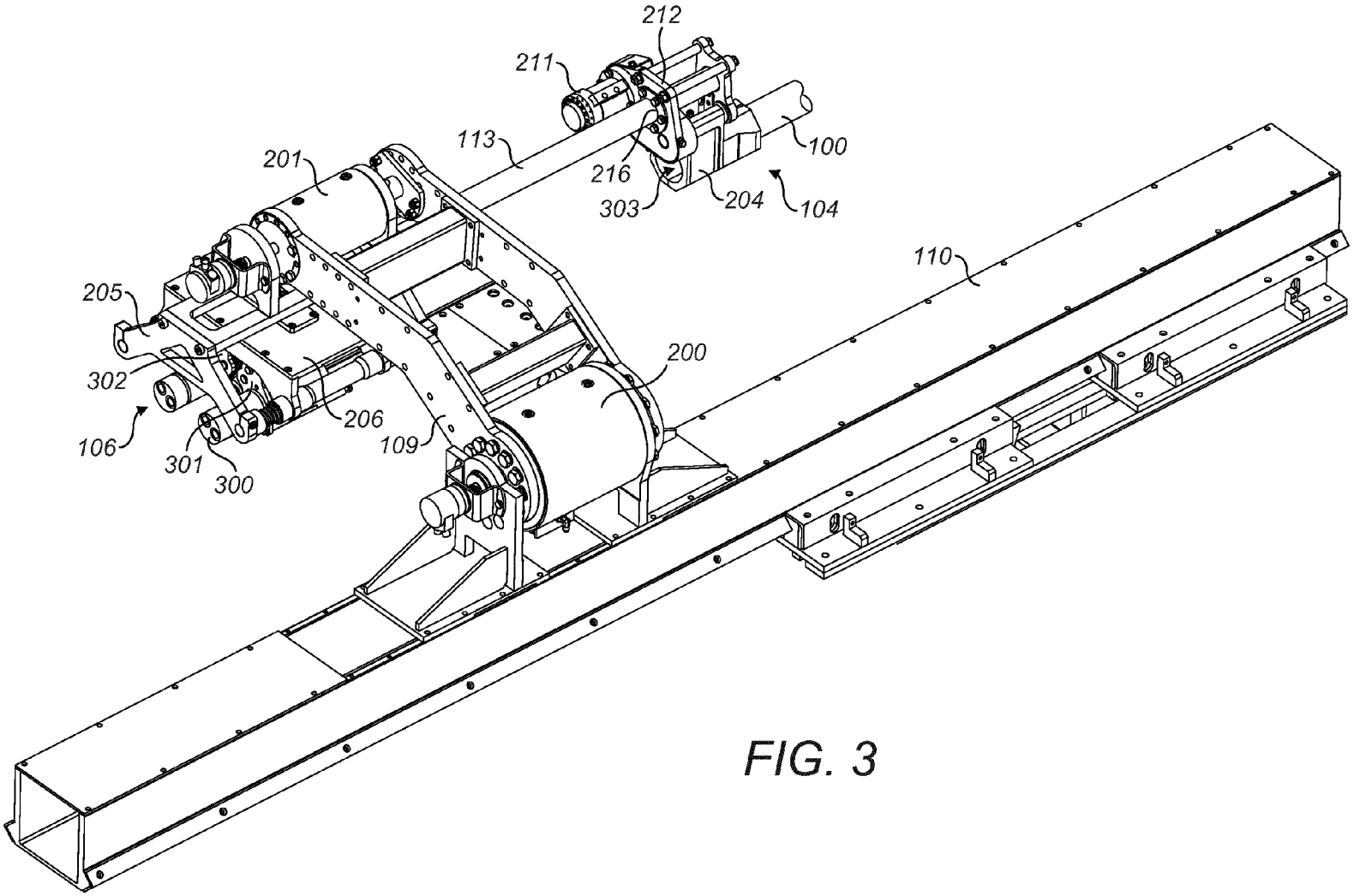
FIG. 3 is a further perspective view of the rod handling apparatus of FIG. 2.
Figure 4:
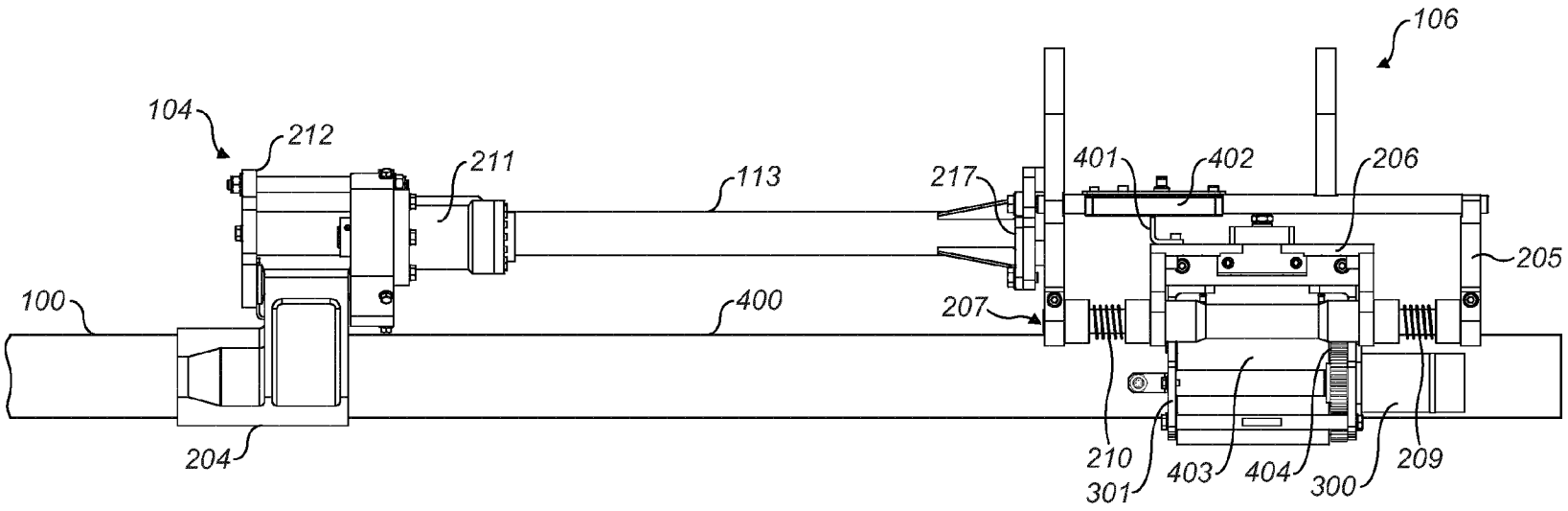
FIG. 4 is a side elevation view of the rod handling apparatus of FIG. 3 engaging a rod to be coupled to a drill string.
Figure 5:
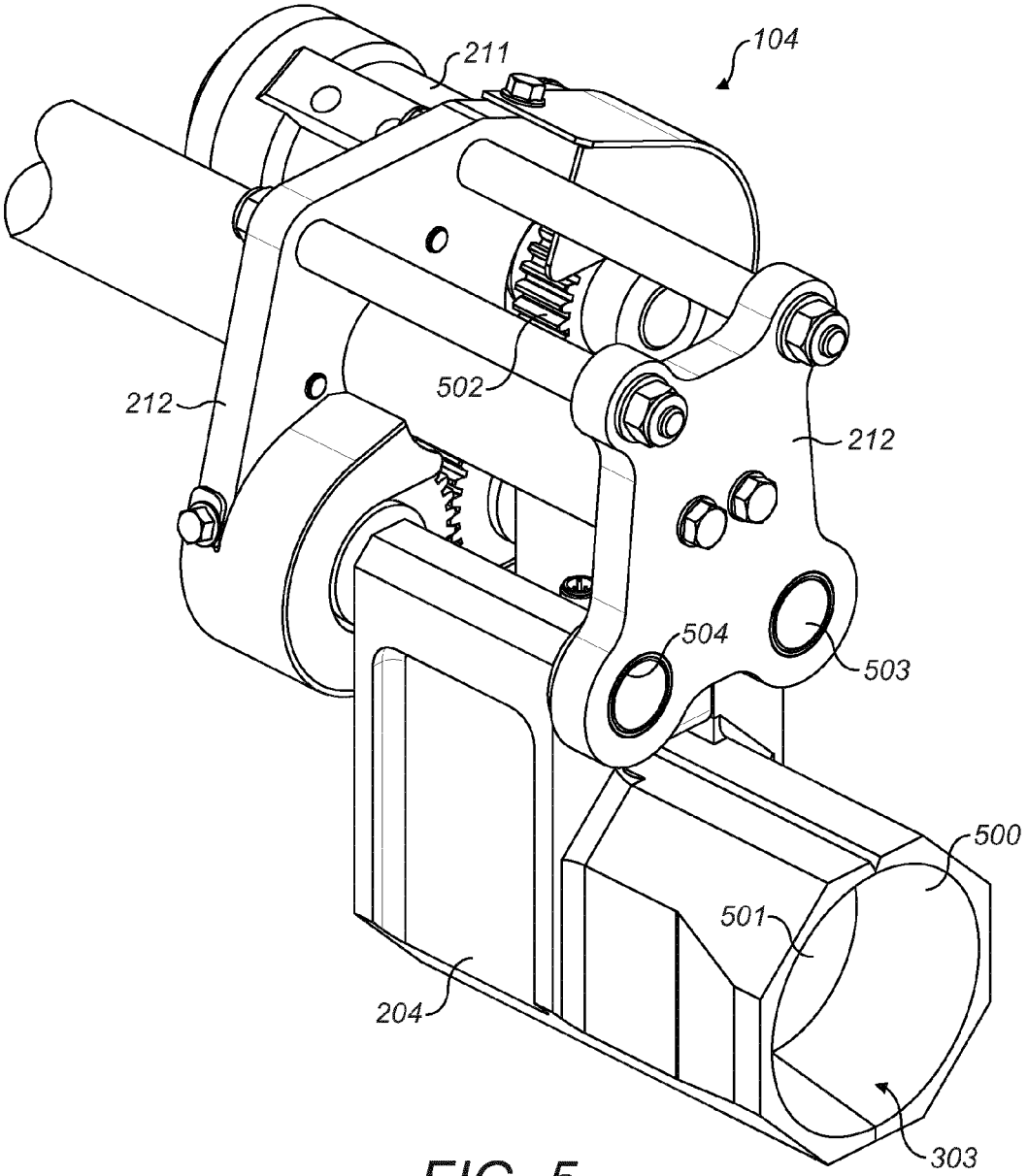
FIG. 5 is front perspective view of an alignment tool forming part of the rod handling apparatus of FIG. 4.
Figure 6:
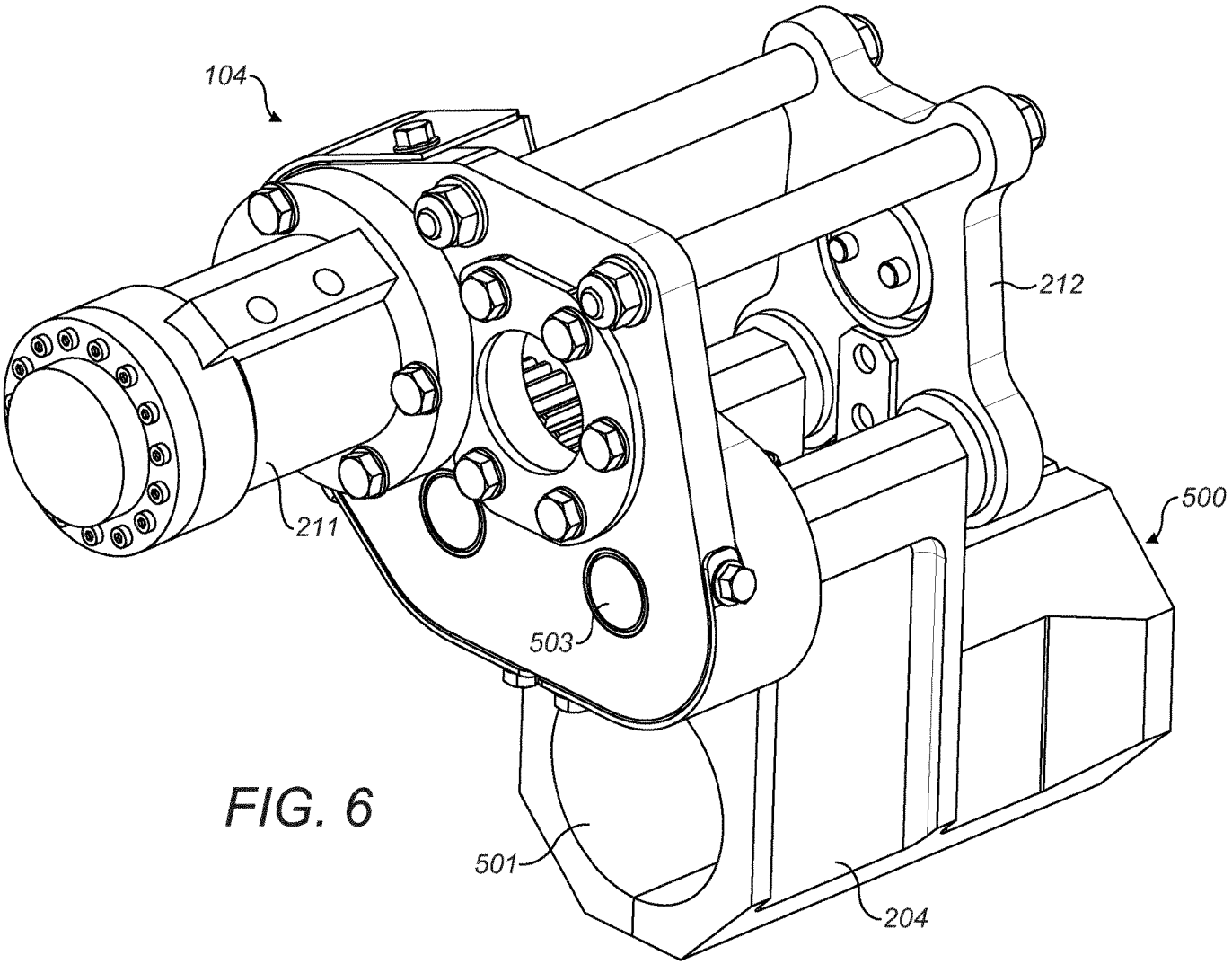
FIG. 6 is a rear perspective view of the alignment tool of FIG. 5.

Referring to FIGS. 2 to 4 actuating arm 109 is mounted at a first end 203 to guide frame 110 via an actuator 200 (being typically a hydraulic, pneumatic or electric motor) to provide pivoting rotation of arm 109 about a pivot axis 213. Gripper unit 106 is mounted at a second end 202 of arm 109. A corresponding actuator 201 is positioned at end 202 to drive rotational mounting of gripper unit 106 at arm 109 to be rotatable about a pivot axis 214. Additionally, drive and movement means (not shown) are provided such that arm 109 is capable of linear translation along the direction of frame 110 to adjust the relative position of the rod during transport to rig 101 in the x axis direction both during coupling and decoupling operations. Via the pivoting mounting of gripper unit 106 at frame 110 (via arm 109), and the axial movement means (not shown) gripper unit 106 is configured for movement in the x, y and z directions during rod transport.

Gripper unit 106 comprises a support frame 205 mounted to arm 109 and a movable sled 206 capable of shuttling back and forth with respect to frame 205 in the F and R directions during rod coupling and decoupling operations. In particular, gripper unit 106 comprises a pair of parallel shafts 207 that extend lengthwise in the x axis direction between a forward and rearward part of frame 205, a forward most side of frame 205 being positioned closest to the drill string 100 (and holder 108 and rotation unit 107). Sled 206 comprises a pair of sleeves 215 configured to slide over respectively each shaft 207 such that sled 206 is suspended in a 'floating' relationship with respect to frame 205. A first pair of rearward bias springs 209 are mounted at a rearward end of each shaft 207 and a corresponding pair of forward mounted bias springs 210 are positioned at a forward end of each shaft 207 axially either end of each sleeve 215. Accordingly, forward springs 210 provide biasing resistance to forward movement of sled 206 in direction F and rearward springs 209 provide resistance to axial movement of sled 206 in reverse direction R.

Gripper unit 106 further comprises a motion tracking sensor arrangement indicated generally by reference 208 mounted at a region of frame 205 and sled 206. Accordingly, a relative axial position of sled 206 (in the x axis direction) relative to frame 205 may be monitored by sensor unit 208.

Elongate beam 113 comprises a first end 216 rigidly mounted at alignment tool 104 and a second end 217 rigidly mounted a region of gripper frame 205. Beam 113 comprises a physical and mechanical configuration and in particular an outside diameter configured to allow alignment tool 104 to deflect laterally in the y and z plane during coupling of the rods in direction F. Alignment tool 104 comprises a pair of moveable jaws 204 pivotally mounted at a support frame 212 a region of which is coupled directly with beam end 216. An actuator 211 (typically a hydraulic, pneumatic or an electric motor) is mounted at frame 212 to drive pivoting displacement of jaws 204 in the y and z plane. In a 'closed' state jaws 204 define an internal coupling chamber 303 into which are received the end portions of the respective end rod 100 of the drill string and rod 400 to be added to the end of the drill string and carried with gripper unit 106.

Gripper unit 106 comprises a pair of opposed rod engagers in the form of gripper jaws 301, 302. Each jaw 301, 302 is capable of movement in a sideways lateral direction away from axis x corresponding generally to movement in the perpendicular y axis direction. Each jaw 301, 302 comprises a pair of jaw engaging rollers 403 (arranged above and below) rotatably mounted upon corresponding axels (not shown) whereby rod 400 is gripped by unit 106 via frictional contact with the four rollers 403 so as to sandwich the rod between opposed jaws 301, 302. Each jaw 301, 302 comprises a respective actuator 300 (being hydraulic, pneumatic or electric motors) mounted at a rearward end of each jaw 301, 302. Each actuator 300 is capable of providing rotational drive to at least one roller 403, via gears 404 mounted on respective drive shafts (not shown) of each actuator 300, so as to impart rotation of rod 400 relative to rod 100. Additionally, a further actuator (not shown) is mounted at sled 206 and is configured to actuate the opening and closing of the respective jaws 301, 302 about rod 115.

Motion sensor 208 is adapted to monitor the relative axial position (in the x axis direction) of sled 206 relative to frame 205. This is achieved via a first sensor part 401 mounted at a region of sled 206 and a second sensor part 402 mounted at frame 205. As rod 400 is gripped substantially rigidly by sled 206, any axial movement of rod 400 relative to frame 205 is determined by the length displacement sensor unit 401, 402. Such a sensor arrangement and its relative mounting position is useful both in the coupling and decoupling operations to provide feedback signals to the automated control unit (not shown) and to identify a correct coupling and decoupling of rods 100, 400.

The function of alignment tool 104 is twofold. Firstly, a primary function is to provide guided coupling between rods 100 and 400 whilst a secondary function is to provide additional support for rod 400 during the transport between rack 103 and rig 101. As the collection of rod 400 from rack 103 typically involves the gripper unit 106 approaching rod 400 from above in the z axis direction, the alignment tool 104 must similarly comprise a jaw arrangement (corresponding to gripper jaws 301, 302) to allow rod 400 to be engaged by both units 104, 106 simultaneously. Accordingly, alignment tool jaw actuator 211 is synchronised with the gripper jaw actuator (not shown) such that the opening and closing of the alignment jaws 204 occurs simultaneously with a corresponding opening and closing of the gripper jaws 301, 302.

Alignment tool actuator 211 provides drive to pivot jaws 204 in the y and z plane via a series of gears 502 mounted at frame 212. Each jaw 204 comprises one half of a generally cylindrical body 700 having an axis aligned substantially with the x axis. A mounting flange 701 extends perpendicular (in the z axis direction) and upwardly from body 700. A bore 702 extends through flange 701 in the x axis direction to receive a mounting pin 503 mounted in turn at frame 212. Accordingly, each jaw 204 is capable of pivoting movement about pin 503 so as to open and close about the axis x corresponding to the longitudinal axis of rod 400.

Figure 7:
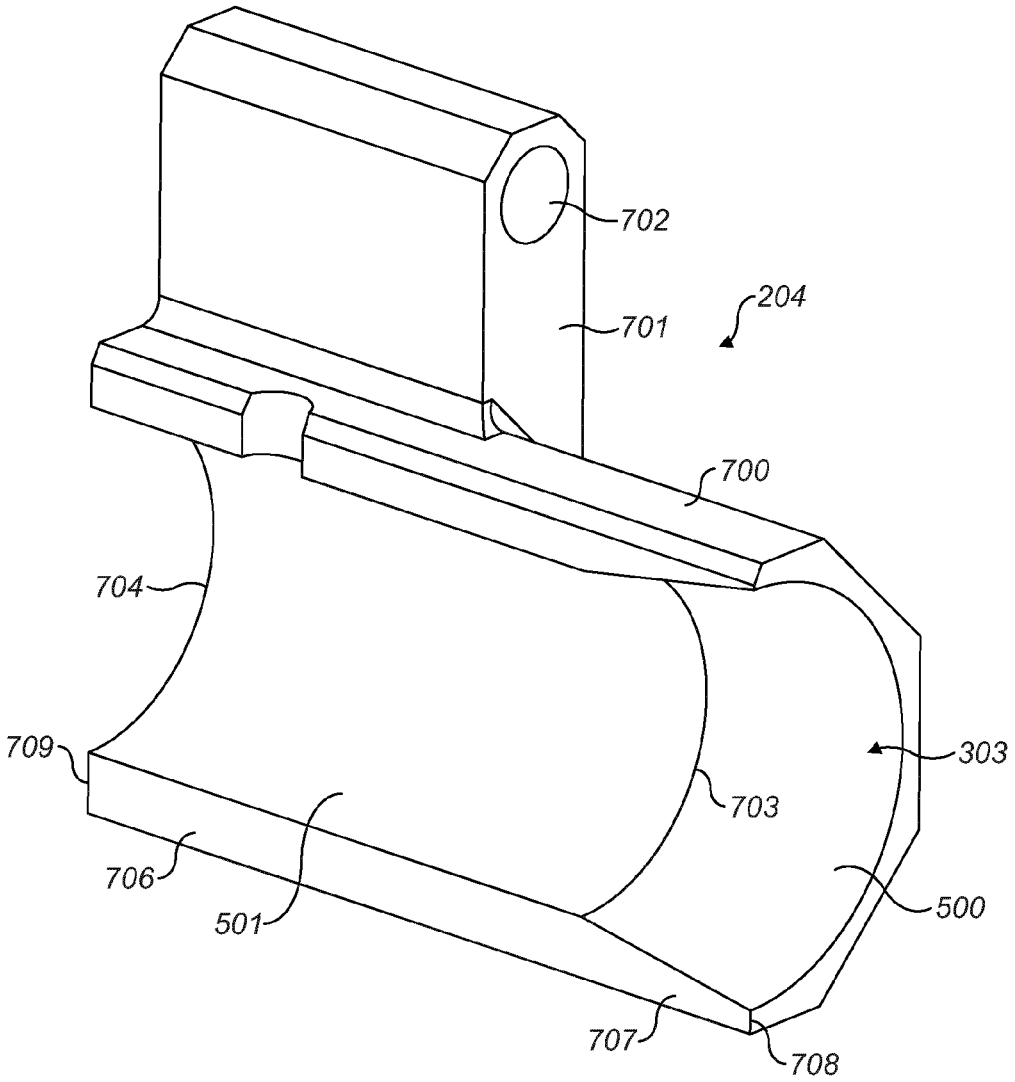
FIG. 7 is a perspective view of one jaw of the alignment tool of FIG. 6 according to a specific implementation of the present invention.
Figure 10:
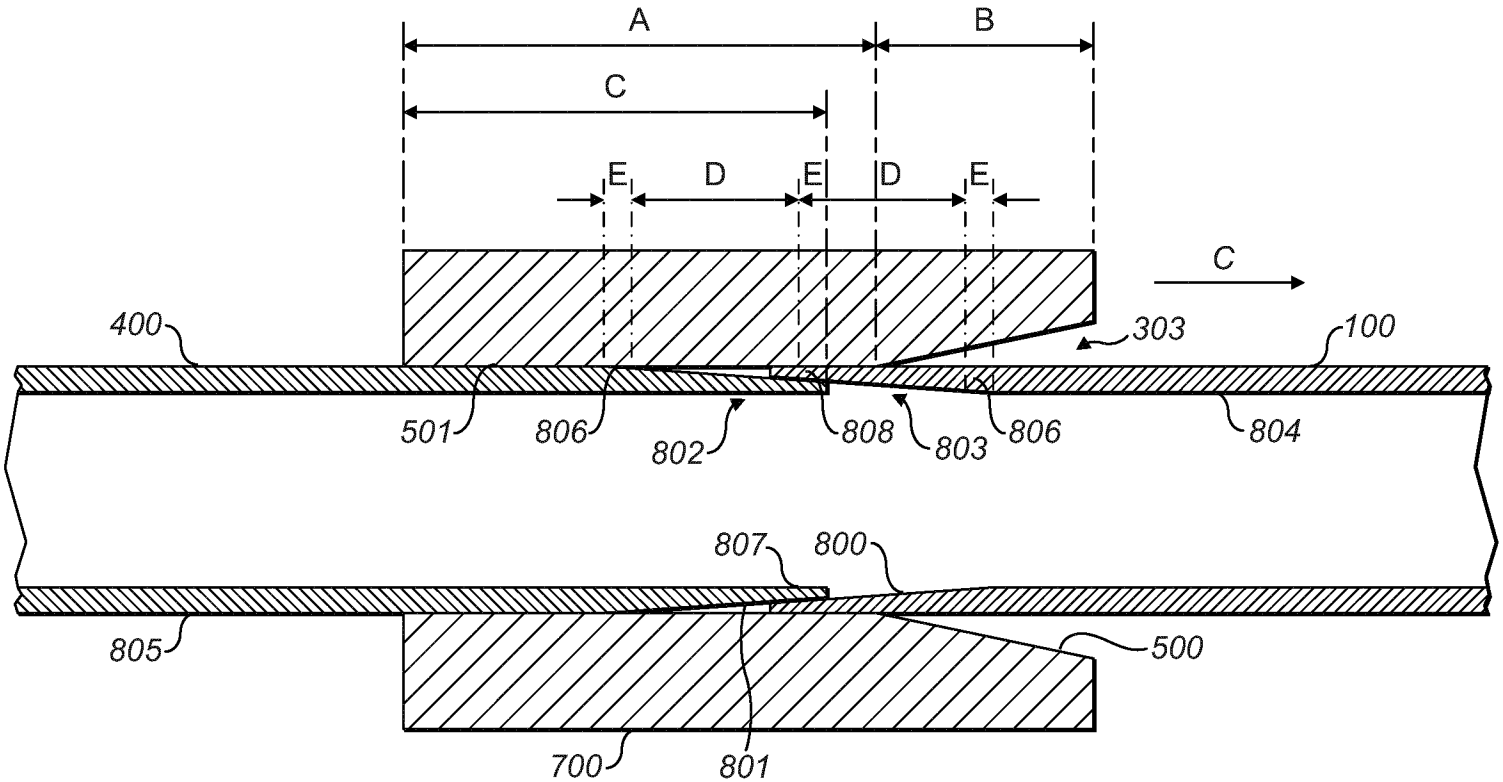
FIG. 10 is a schematic cross sectional view through a part of the alignment tool jaw of FIG. 9 in the coupling of two rods together end-by-end.

As illustrated in FIGS. 7 and 10, the internal profile of each body part 700 is configured specifically to ensure a desired mating between the coupling ends of rods 100 and 400. In particular, each rod 100, 400 comprises a first respective male treaded connection provided at a first end and corresponding female threaded connection provided at an opposed second end. The internal chamber 303 as defined by the closed jaws 204 accordingly comprises a sleeve section 706 having an internal surface with a cylindrical shape configuration 501.

Sleeve 706 comprises a first forward most end 703 and a second rearward most end 704 with respect to the position of drill string 100. A longitudinal axis of sleeve 706 is positioned coaxially with the longitudinal axis of the drill string 100 when the rod handling apparatus 102 is positioned at rig 101 to provide coupling between rods 100, 400. Jaw body 700 further comprises a mouth section 707 extending from the first end 703 of sleeve 706. An internal facing surface 500 of mouth 707 is flared radially outward from the longitudinal axis of sleeve 706 and cylindrical surface 501. According to the specific implementation, surface 500 extends radially outward from surface 501 at an angle in the range 8 to 15°. An axial length of mouth section 707 is substantially equal to one third of the axial length of sleeve 706. Accordingly, a diameter or width of the opening into internal chamber 303, as defined by the 'closed' jaws 204, is greater at a first forward facing end 708 with respect to a second rearward facing end 709 of body 700.

Accordingly, internal facing surface 500 of mouth section 707 comprises a generally frusto conical shape configuration in which the smaller diameter end of the cone is positioned at cylinder end 703 whilst the largest diameter end of the cone corresponds to first end 708 of cylindrical body 700.

Figure 8:
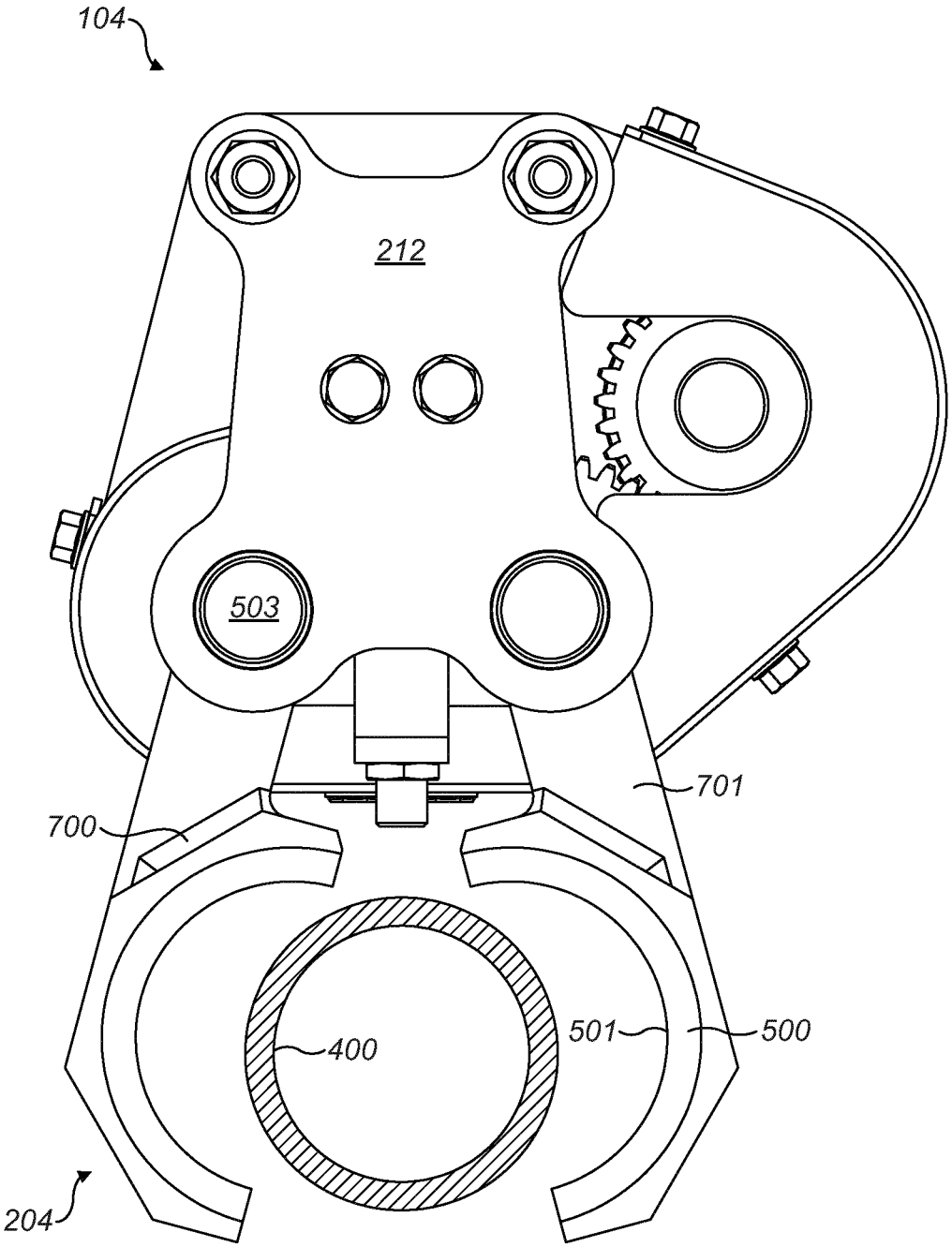
FIG. 8 is a front view of the alignment tool of FIG. 6 in a rod non-engaging position.
Figure 9:
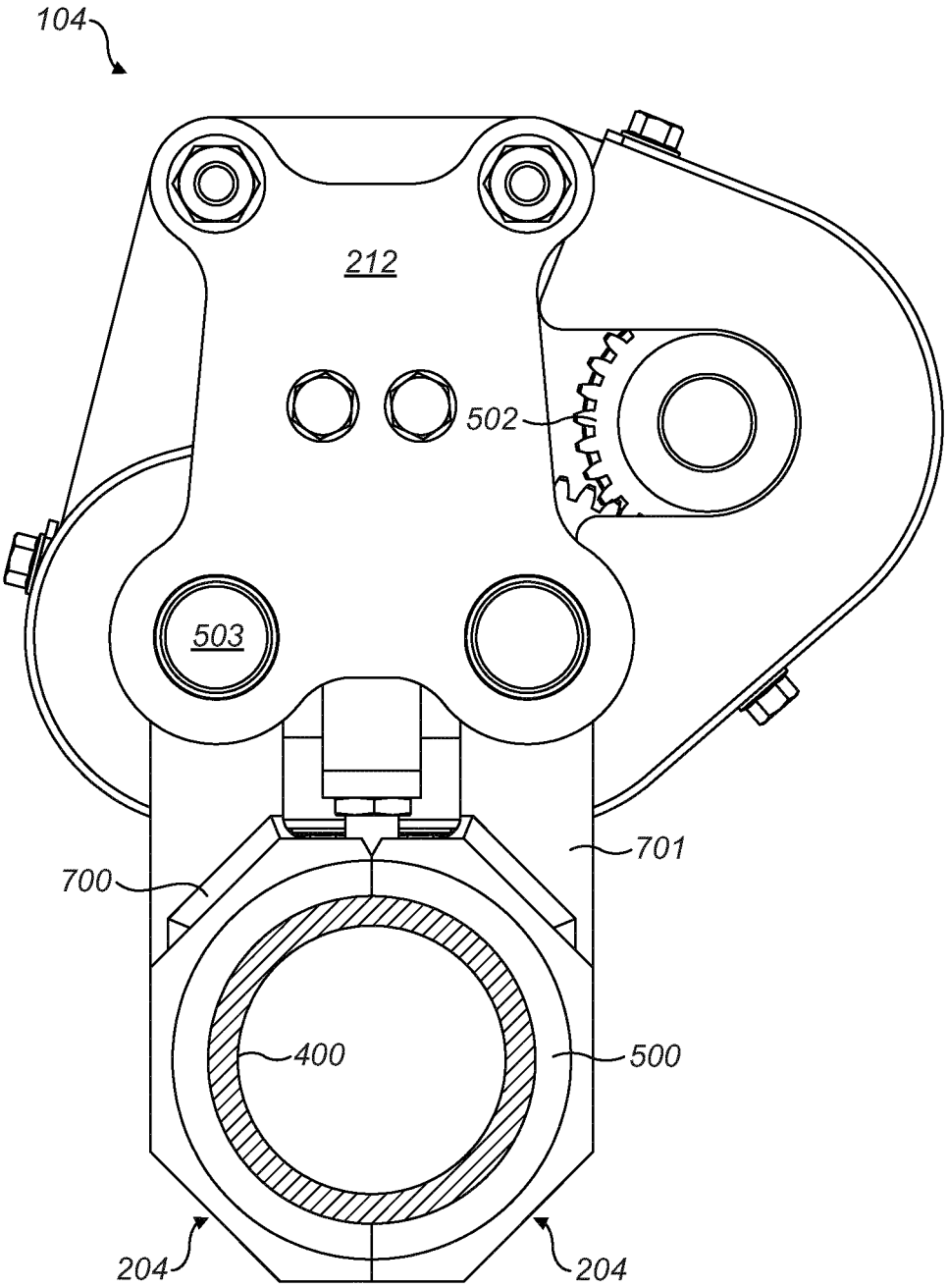
FIG. 9 is a front view of the alignment tool of FIG. 8 in a rod engaging position.

FIG. 8 illustrates a relative positioning of jaws 204 that close around rod 400 to be transported from rack 103 to rig 101 whilst FIG. 9 illustrates the corresponding position of jaws 204 'closed' around rod 400. A diameter of cylindrical surface 501 is configured to be slightly greater than the external diameter of rod 400 such that jaws 204 do not grip rod 400 but hold the rod 400 to enable a small degree of lateral movement (in the y and z plane) and allow rod 400 to rotate and slide axially relative to jaws 204.

FIG. 10 illustrates the coupling procedure of rods 100, 400 in direction F. As indicated, each rod comprises a male thread connection 802 provided at a first end and a female threaded connection 803 at the alternate second end. Screw threads 800 extend over the internal surface 804 of rod 100 at region 803 and corresponding screw threads 801 are provided at the external facing surface 805 of rod 400 at region 802. Each connection region 802, 803 comprises an axially short cylindrical guiding surface 806 having an axial length E. Such that an axial length of threads 800, 801 comprises a length D.

Rod handling unit 102 is configured to collect rod 400 from rack 103 such that the first male end region of rod 400 is accommodated within internal chamber 303. In particular, the end of rod 400 extends axially within cylindrical sleeve 501 by a distance C to be positioned axially rearward of end 703 and mouth section 707. Accordingly, an axial length A of cylindrical section 501 is greater than length C such that approximately 70 to 90% of length A is occupied by the end of rod 400 (length C). When rod handling unit 102 is positioned at rig 101 (such that rods 100, 400 are axially aligned) the gripper unit 106 and alignment tool 104 are advanced axially in direction F along the x axis. Mouth section 707 moves axially over the female end of rod 100 which is in turn received within the internal chamber 303 of body 700. Any lateral misalignment (in the y-z plane) is accommodated by the tapering internal surface 500 which acts as a guide funnel to slightly adjust the lateral position (in the y-z plane) of the male end of rod 400. In particular, it is the alignment tool 104 that is deflected laterally on engagement with rod 100 as rod 100 is held firmly by unit 108 and 107 and is, to a large extent, incapable of any lateral movement in the y-z plane. Accordingly, body 700 is re-centred by rod 100 to allow the end 808 of rod 100 to pass into cylindrical section 501 and to axially overlap an end 807 of rod 400 within section 501. This lateral deflection of alignment tool 104 is provided by the lateral flexing of beam 113.

According to further specific implementations, an axial length B of conical section 707 may be greater or less than the relative length illustrated in FIG. 10 with respect to axial length A of section 501. Additionally, the angle by which the internal facing surface 500 extends radially outward from surface 501 may be greater or less than that illustrated in FIG. 10. Accordingly, the alignment tool 104 may be configured to compensate for large axial misalignment between rods 100, 400. Where actuator 211 comprises a hydraulic unit, jaws 204 are maintained closed about rod 400 as illustrated in FIG. 9 by applying a hydraulic over-pressure at unit 211.

According to further specific implementations, coupling sleeve section 706 may comprise any guide means to surround the end regions of each rod 100, 400 that are aligned substantially axially with the longitudinal axis of each rod. For example, sleeve section 706 may comprise a plurality of parallel strips, rods or flanges. Additionally, mouth section 707 may equally comprise a plurality of separate elements that act to guide lateral movement of coupling section 706 into axial alignment with rod 100. Accordingly, mouth section 707 may comprise a plurality of flanges that project radially outward from the end 703 of coupling section 501.

The invention claimed is:

1. A drill rod handling apparatus arranged to feed rods to and from a drill string created by a drill rig, the apparatus comprising:

a gripper unit including rod engagers for contacting and holding a first rod to be transported to the drill rig, the gripper unit being pivotally and axially movably mounted for movement in x, y and z directions during rod transport;

a transporter to transport the gripper unit from a rod collection position to a rod coupling position at the drill rig, such that the first rod is aligned axially with the drill string at the rod coupling position, the gripper unit including a support frame mounted to the transporter and a sled axially movable with respect to the support frame; and an alignment tool mounted at the gripper unit via an elongate connector, the alignment tool having a pair of alignment jaws, at least one of the jaws being moveable to allow the jaws to open and close around the first rod, wherein a part of the jaws when in a closed state defines a coupling region, and a guide mouth projecting radially outward from one end of a part of the coupling region to guide axial alignment of the coupling region over a second rod forming an end of the drill string to provide aligned coupling of the first and second rods within the coupling region.

2. The apparatus as claimed in claim 1, wherein each jaw is pivotally mounted at the support frame to move radially to and from a longitudinal axis extending through the coupling region.

3. The apparatus as claimed in claim 1, wherein the coupling region includes a sleeve having a radially inward facing surface with a substantially cylindrical shaped profile.

4. The apparatus as claimed in claim 1, wherein the guide mouth includes a radially inward facing surface having a substantially conical shaped profile.

5. The apparatus as claimed in claim 1, further comprising a drive actuator mounted at the support frame and coupled to at least one of the jaws to drive movement of the at least one jaw to open and close around the first rod.

6. The apparatus as claimed in claim 1, wherein a first end of the elongate connector is mounted at the gripper unit and a second end of the elongate connector is mounted at the alignment tool, the connector being configured to flex in a direction laterally of its longitudinal axis such that the alignment tool is capable of lateral deflections relative to the gripper unit.

7. The apparatus as claimed in claim 1, wherein the rod engagers include a pair of rod engaging jaws moveable to open and close about the first rod and engaging rollers mounted at the jaws for contacting and holding the first rod in a clamped position at the gripper unit.

8. The apparatus as claimed in claim 7, wherein the coupling region is positioned substantially coaxially with the rod engaging jaws so that a first region of the first rod may be gripped by the rod engaging jaws and a second region of the first rod may be surrounded by the alignment jaws.

9. The apparatus as claimed in claim 1, further comprising at least one sensor mounted at the gripper unit to detect an axial movement change between the gripper unit and the first rod.

10. The apparatus as claimed in claim 1, wherein the guide mouth projects radially outward from an inward facing surface the coupling region at an angle in the range 5 to 20°.

11. An automated drill rod handling assembly comprising:

a drill rod handling apparatus arranged to feed rods to and from a drill string created by a drill rig, the apparatus including a gripper unit having rod engagers arranged to contact and hold a first rod to be transported to the drill rig, the gripper unit being pivotally and axially movably mounted for movement in x, y and z directions during rod transport, and a transporter arranged to transport the gripper unit from a rod collection position to a rod coupling position at the drill rig, such that the first rod is aligned axially with the drill string at the rod coupling position, the gripper unit including a support frame mounted to the transporter and a sled axially movable with respect to the support frame, and an alignment tool mounted at the gripper unit via an elongate connector, the alignment tool having a pair of alignment jaws, at least one of the jaws being moveable to allow the jaws to open and close around the first rod, wherein a part of the jaws when in a closed state defines a coupling region, and a guide mouth projecting radially outward from one end of a part of the coupling region to guide axial alignment of the coupling region over a second rod forming an end of the drill string to provide aligned coupling of the first and second rods within the coupling region; and a device to control movement of the gripper unit and the alignment tool relative to the drill string according to an automated sequence.

12. A drill rig arranged to feed rods to and from a drill string, the drill rig comprising:

a feed frame;

a rotation unit mounted at the feed frame to provide rotational drive to the drill string;

a rod holder mounted at the feed frame to mount an end region of the drill string, the rotation unit being axially slidable to and from the rod holder; and a rod handling apparatus configured to transport rods between rod collection and rod coupling positions to axially align a first rod with an end rod of the drill string held by the rod holder and/or the rotation unit, the apparatus including a gripper unit having rod engagers arranged to contact and hold the first rod to be transported to the drill rig, the gripper unit being pivotally and axially movably mounted for movement in x, y and z directions during rod transport, and a transporter arranged to transport the gripper unit from a rod collection position to a rod coupling position at the drill rig, such that the first rod is aligned axially with the drill string at the rod coupling position, the gripper unit including a support frame mounted to the transporter and a sled axially movable with respect to the support frame, and an alignment tool mounted at the gripper unit via an elongate connector, the alignment tool having a pair of alignment jaws, at least one of the jaws being moveable to allow the jaws to open and close around the first rod, wherein a part of the jaws when in a closed state defines a coupling region, and a guide mouth projecting radially outward from one end of a part of the coupling region to guide axial alignment of the coupling region over a second rod forming an end of the drill string to provide aligned coupling of the first and second rods within the coupling region.

13. A method of feeding rods to a drill string created by a drill rig, the method comprising:

contacting and holding a first region of a first rod at a rod collection position via rod engagers positioned at a gripper unit, the gripper unit being pivotally and axially movably mounted for movement in x, y and z directions;

moving the gripper unit from the rod collection position to a rod coupling position where the first rod is aligned substantially axially with a second rod forming an end part of the drill string;

engaging a second region of the first rod axially separated from the first region by an alignment tool having a pair of alignment jaws that close around the second region and support the first rod via a coupling region defined by the jaws during the step of contacting the first region of the rod with the rod engagers;

axially advancing the first rod towards the second rod; and guiding engagement of the second rod within the coupling region via a guide mouth flared radially outward from a part of the coupling region to position the first and second rods at least partially within the coupling region in axial alignment to be coupled.

14. The method as claimed in claim 13, wherein the step of contacting and holding the first region of the first rod includes engaging the first region by the pair of engaging jaws that close around the first rod.

15. The method as claimed in claim 14, further comprising synchronizing the closing of the engaging jaws and alignment jaws around the rod.

* * * * *